US008664853B1

(12) United States Patent
Montgomery et al.

(10) Patent No.: US 8,664,853 B1
(45) Date of Patent: Mar. 4, 2014

(54) SINTERED WIRE CESIUM DISPENSER PHOTOCATHODE

(75) Inventors: Eric J. Montgomery, Dayton, MD (US); R. Lawrence Ives, San Mateo, CA (US); Louis R. Falce, Surprise, AZ (US)

(73) Assignees: Calabazas Creek Research, Inc., San Mateo, CA (US); University of Maryland, College Park, MD (US)

( * ) Notice: Subject to any disclaimer, the term of this patent is extended or adjusted under 35 U.S.C. 154(b) by 0 days.

(21) Appl. No.: 13/587,200

(22) Filed: Aug. 16, 2012

Related U.S. Application Data

(60) Provisional application No. 61/658,924, filed on Jun. 13, 2012.

(51) Int. Cl.
*H01J 40/06* (2006.01)

(52) U.S. Cl.
USPC ..... 313/542; 313/13; 445/49

(58) Field of Classification Search
USPC ..... 313/523–544, 103 R, 103 CM, 104, 313/105 R, 105 CM, 13; 445/49–51
See application file for complete search history.

(56) References Cited

U.S. PATENT DOCUMENTS

| | | | | |
|---|---|---|---|---|
| 5,402,034 | A * | 3/1995 | Blouch et al. | 313/370 |
| 6,803,704 | B2 * | 10/2004 | Motoi et al. | 313/103 R |
| 8,221,181 | B2 * | 7/2012 | Downing et al. | 445/49 |
| 2009/0127642 | A1 * | 5/2009 | Yamashita et al. | 257/431 |

* cited by examiner

*Primary Examiner* — Anne Hines
(74) *Attorney, Agent, or Firm* — File-EE-Patents.com; Jay A. Chesavage

(57) ABSTRACT

A photoelectric cathode has a work function lowering material such as cesium placed into an enclosure which couples a thermal energy from a heater to the work function lowering material. The enclosure directs the work function lowering material in vapor form through a low diffusion layer, through a free space layer, and through a uniform porosity layer, one side of which also forms a photoelectric cathode surface. The low diffusion layer may be formed from sintered powdered metal, such as tungsten, and the uniform porosity layer may be formed from wires which are sintered together to form pores between the wires which are continuous from the a back surface to a front surface which is also the photoelectric surface.

19 Claims, 5 Drawing Sheets

Cesium Photocathode with integral low-diffusion layer integrated with controlled porosity layer Cesium Photocathode
Prior Art Cesium Photocathode with intermediate free volume layer Cesium Photocathode with integral low-diffusion layer integrated with controlled porosity layer Tungsten wires before sintering Tungsten wires after sintering Tungsten wires cut into disks Photocathode Efficiency vs Lifetime Recesiation tests @ 325 °C

SINTERED WIRE CESIUM DISPENSER PHOTOCATHODE

The present invention was developed under the United States Department of Energy grant #DE-SC0006208. The government has certain rights in the invention.

FIELD OF THE INVENTION

The present patent application claims priority of the provisional patent application 61,658,924 filed Jun. 13, 2012.

The present invention relates to a photocathode for converting incoming photon energy into electrons, such as for photon detection or electron beam generation. In particular, the invention is directed to a high efficiency, long life dispenser photocathode for the generation of a beam of electrons in response to an incident drive laser beam.

BACKGROUND OF THE INVENTION

The present photocathode is a device for the generation of a beam of electrons. One prior art method for the generation of an electron beam is a thermionic cathode, such as a Pierce electron gun or a Brillouin electron gun, both of which utilize a cathode heated to a sufficiently high temperature to release electrons through thermionic emission. Unlike a traditional thermionic cathode, a photocathode generates an electron beam when a high intensity optical source such as a laser impinges onto a cathode, relying on the quantum efficiency (QE) of the photocathode target material to convert the incoming photons into an electron beam. One advantage of the photocathode is the ability to operate at any temperature, and the ability to generate electrons for picosecond time intervals by modulating the laser with picosecond pulses.

FIG. 1 shows a prior art cesium photocathode 100, having a photoelectric surface 116 which is impinged by photons from an optical source shown as laser beams 106 and 108, and the photoelectric effect causes the release of electrons at various release angles 102, 104, 118, as shown. While a cesium photocathode has improved quantum efficiency, the surface is sensitive to contamination, and known prior art cesium coatings have a high evaporation rate, which results in an undesirably short cathode lifetime, as the loss of surface cesium results in the associated loss of quantum efficiency. Another problem is that the quantum efficiency of a cesium cathode is dependant on the cesium coating thickness.

It is desired to provide a long lifetime cesium photocathode with a high quantum efficiency. It is also desired to provide a method to optimize the quantum efficiency of a cesium coated photocathode, and maintain the operation of the photocathode at an optimum quantum efficiency over time.

OBJECTS OF THE INVENTION

A first object of this invention is a dispenser photocathode having a housing such as a closed cylinder which is open on a photocathode end, the housing providing, in sequence:

a work function lowering material such as cesium for enabling a photoelectric effect, the work function lowering material adjacent to a low diffusion layer which limits the flow of work function lowering material enclosed by the housing and the low-diffusion layer;

the low diffusion layer having the work function lowering material on one side and a free volume layer on an opposite side, the free volume layer allowing for the generation of a uniform density of work function lowering material;

the free volume layer adjacent to a uniform porosity layer having an outer photoelectric effect surface, the uniform porosity layer formed by sintering a plurality of wires to form voids therebetween, the voids forming a regular and uniform pattern of apertures for the passage of work function lowering material from the free volume layer to the photoelectric surface.

A second object of the invention is a dispenser photoelectric cathode having:

an enclosure which is open on one end;

a dispenser region formed from said enclosure and enclosing a work function lowering material such as cesium;

a combined low-diffusion layer and uniformly porous layer formed from sintered wires and placed adjacent to the work function lowering material;

the enclosure in thermal contact with a heater for performing temperature control on the dispenser photoelectric cathode to control a diffusion rate of the work function lowering material through the low-diffusion layer, thereby providing for the control of the quantum efficiency of the device through control of the diffusion rate through the low-diffusion layer.

A third object of the invention is a method for determining a maximum quantum efficiency of a photoelectric cathode utilizing a work function lowering material delivered to the photoelectric target at a controllable rate, the method having the steps:

modulating the temperature of the heater from Tmax to a temperature sufficiently low to reduce the quantum efficiency, thereby modulating the rate of delivery of the work function lowering material;

examining the quantum efficiency of the photoelectric cathode during heating and cooling cycles;

if a first peak during a heating cycle and a second peak during a cooling cycle is detected, lowering the heater temperature Tmax until only a single peak is detected;

using the heater temperature Tmax for subsequent photoelectric cathode operation.

SUMMARY OF THE INVENTION

In one aspect of the invention, a heated pellet of a work function lowering material such as a pellet of compressed cesium is placed into an enclosure having a first low diffusion layer which impedes the flow of cesium and delivers the cesium to a free space region, the free space region coupled to a uniform porosity layer having a plurality of apertures formed by the sintering of wires into a porous disk, allowing the cesium to escape through the plurality of apertures to a photoelectric cathode surface, the plurality of apertures having uniform spacing over the surface of the photoelectric cathode.

In another aspect of the invention, a reservoir of cesium is placed into a heated cavity having a front-facing aperture, the front-facing aperture having a porous disk formed from a plurality of elongate wires sintered to form continuous pores therebetween, the porous disk thereby functioning both to limit a diffusion rate and also having a uniform porosity over the front-facing aperture extent, and thereby emitting a uniform density of cesium onto the photoelectric cathode surface and at a rate controlled by a heater coupled to the cesium.

In another aspect of the invention, the porous disk is formed from a plurality of equal-diameter tungsten wires which are sintered together.

In another aspect of the invention, the porous disk is formed from a plurality of unequal diameter tungsten wires which are sintered together.

In another aspect of the invention, the porous disk is formed from a powder which is sintered into the porous disk. In one aspect of this invention, the porous disk is formed from a metal powder. In another aspect of the invention, the porous disk is formed from metallic powder which, after sintering, is porous from a front surface to a back surface, the front surface forming a photoelectric surface and the back surface adjacent to the free space region.

In another aspect of the invention, the porous disk is formed using a refractory metal, including at least one of the refractory metals: niobium, molybdenum, tantalum, tungsten, and rhenium, or any metal with a melting point above 2000° C. and high hardness at room temperature, which may additionally include any of: titanium, vanadium, chromium, zirconium, hafnium, ruthenium, osmium and iridium. In another aspect of the invention, the porous disk is formed using any metal or metal alloy which has a melting temperature above the operating temperature of the photocathode, and in another aspect of the invention, the porous disk is formed from a metal or metal alloy which has a melting temperature at or above 600° C.

In one example embodiment, the quantum efficiency is improved by introducing a layer which forms an intermetallic compound with the cesium, the layer coating at least part of the uniform porosity layer or low diffusion layer and having at least one of the elements: antimony (Sb), gold (Au), tellurium (Te), bismuth (Bi), indium (In), gallium (Ga), thorium (Th).

In another example embodiment, improvement in quantum efficiency can be realized by internally creating an alloy of Cs by coating at least part of the uniform porosity layer or low diffusion layer with at least one of the elements: molybdenum (Mo), cobalt (Co), nickel (Ni), bismuth (Bi), platinum (Pt), or tantalum (Ta).

In another example embodiment, improvement in quantum efficiency can be realized by coating at least part of the uniform porosity layer or diffusion layer with an intermetallic compound, including at least one of osmium (Os), ruthenium (Ru), silver (Ag), or copper (Cu). The intermetallic compounds form a non-reactive layer over the uniform porosity layer or diffusion layer, which are subsequently coated with a sub-monolayer of Cs only, thereby providing well-defined surface diffusion and a quantum efficiency improvement over cesium-tungsten (CsW) alone. Additionally, silver may be activated by oxygen, such as by applying a silver layer over a substrate, and oxidizing the silver to provide an activation layer by elevating the temperature of the substrate and silver, followed by deposition of cesium over the activated silver in a submonolayer coating, which activated silver may provide for an additional improvement in quantum efficiency.

In another aspect of the invention, the porous disk is formed from tungsten coated with Te (tellurium).

In another aspect of the invention, cesium is provided to a heated enclosure having a front-facing aperture, the cesium coupled through the heated enclosure to, in sequence, a first surface of a sintered powdered disk for the regulation of rate of delivery of the cesium, the sintered powdered disk having a second surface on the opposite side coupled to a free volume layer for generating a uniform density of cesium, the free volume layer coupled to a first surface of a sintered wire disk having a plurality of apertures for the coupling of the cesium in the free volume layer to a photoelectric surface formed from the second surface of the sintered wire disk, the photoelectric surface for interaction with a photonic source such as a laser beam.

In another aspect of the invention, an optimum operating point is determined by examining the quantum efficiency while heating and cooling the work function lowering material and examining the quantum efficiency for multiple peaks. When the heater driven feed rate of the work function lowering material is excessively high, a double peak is detected in the quantum efficiency, and the feed rate of the work function lowering material is lowered until the quantum efficiency has a single peak through a heating and cooling cycle. In one embodiment of the invention, the work function lowering material is enclosed in a volume coupled to a low diffusion layer and coupled to a heater element such that the feed rate of the work function lowering material is thereby controlled by changing the temperature of the work function lowering material.

DETAILED DESCRIPTION OF THE INVENTION

Figure 1:
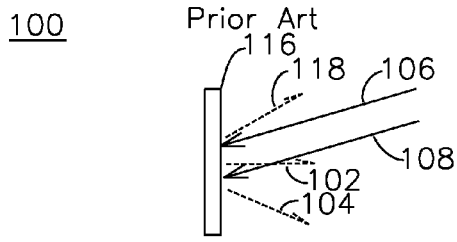
FIG. 1 is a cross section view of a prior art photoelectric cathode.
Figure 2:
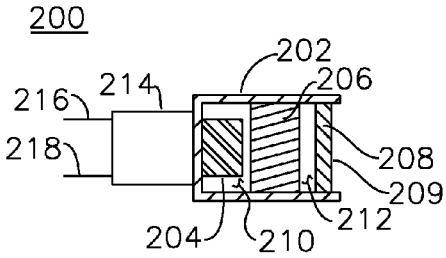
FIG. 2 is a cross section view of a cesium photocathode with a low-diffusion layer, a free volume layer, and a uniform porosity high diffusion layer.

FIG. 2 shows a three stage cesium photocathode 200 according to one embodiment of the invention. A heater element 214 such as an electric heater with lead wires 216, 218 delivers thermal energy to a work function lowering material such as cesium 204. It is understood that any work function lowering material 204 may be used, and cesium is shown in the present example only for clarity of understanding the invention. The enclosure 202 may be formed of stainless steel, or any suitable material, and the enclosure directs cesium vapor generated by the heater element 214 to low diffusion layer 206 and thereafter to free volume layer 212, and thereafter to uniform porosity layer 208 which has a front surface for passage of the cesium vapor for interaction with incoming photonic energy at the front surface 209. The front surface 209 of uniform porosity layer 208 is also known as the photoelectric surface, where interaction between photons and cesium which has passed through the pores of the uniform porosity layer 208 may occur.

The primary objective of the various structures of the present invention shown in FIG. 2 is to create conditions at the photoelectric surface 209 which result in maximum quantum efficiency (QE) in conversion of incoming photons into free electrons, and also provide a long lifetime of the cesium 204 supply before depletion, as will be described.

The low diffusion layer 206 has the objective of metering the passage of cesium from the cesium reservoir 204 into the free space layer 212 at controllable rates which may be used to optimize quantum efficiency at the photocathode surface 209. Low diffusion layer 206 may be formed from sintered tungsten powder, and has the primary characteristic of limiting diffusion and thereby controlling the rate of consumption (and delivery) of the cesium 204 to free volume layer 212. The grain size, distribution, and sintering time of layer 206 are selected such that the diffusion rate provides the required density of cesium at the front photoelectric surface of the controlled porous layer 208. Additionally, the rate of delivery of cesium is controllable by the temperature of the cesium through application of power to the heater element 214. In this manner, the volume defined by enclosure 202 and bounded by low diffusion layer 206 forms a reservoir which may be partially or completely filled with cesium 204 which is dispensed through controlled porous layer 208 at a rate controllable by the temperature of electric heater 214.

The cesium vapor which passes through low diffusion sintered powder layer 206 at the required rate subsequently passes into the free volume layer 212, which provides a free space mixing volume and uniform density of cesium throughout the open volume forming the free space layer 212, and the cesium from the free space layer 212 is next coupled through the uniform porosity layer 208, which has a bulk structure which provides a high diffusion rate for cesium compared to the low diffusion layer 206 which governs the cesium diffusion rate from the cesium reservoir 204. In one embodiment of the invention, low diffusion layer 206 is formed from sintered wires having continuous pore channels formed in the regions surrounding the wires and having a pore extent from the surface adjacent to the free space layer 212 to the photoelectric interaction surface 209 on the opposite side of uniform porosity layer 208. In another embodiment of the invention, the low diffusion layer 206 is formed from a sintered powdered metal where the internal sintered powder is porous from the surface adjacent to the free space layer 212 to the photoelectric surface 209, and the grain size and extent of sintering are selected to control the rate of diffusion of cesium from reservoir 204.

In one embodiment of the invention, either the uniform porosity layer 208 or the low diffusion layer 206 is formed from sintered wires, such as 20 u diameter tungsten wire with the continuous pores formed in the voids between the sintered wires and oriented parallel to the axes to the sintered wires and creating continuous inter-wire channels on the order of 4 microns in cross section measurement. In another embodiment of the invention, either the low diffusion layer 206 or the uniform porosity layer is formed from a sintered powder metal having a sintered pore size on the order of 1 micron.

The path for cesium through a porous sintered powder is tortuous and convoluted, as the cesium diffuses around the particles, which provides greater resistance to diffusion compared to the elongate pores formed between the sintered wires. In one example, the low diffusion layer 206 sintered powder is on the order of 70%-80% density, the powder grain size is on the order of 3-5 microns, the sintered powder disk is 0.5 mm-1 mm thick and 0.27 inch diameter, and the resulting diffusion rate at 500° C. to 600° C. is on the order of 10-100 ug/cm$^2$/hr. It is understood that other physical parameters are possible, and these are given only for purposes of example and do not limit the practice of the invention to this particular example.

In another embodiment of the invention, either layer 206, layer 208, or both layers 206 and 208 have a porosity which is selected to control the cesium diffusion rate from reservoir 204, and layer 208 is further selected to provide uniform distribution of cesium at the photoelectric surface 209. Layers 206 or 208 may be formed using powdered sintered metal, sintered wires as described in FIG. 5, or any method which allows for control of diffusion rates from reservoir 204 to photocathode surface 209.

The table below indicates experimental measurements for the assembly of FIG. 3 for the example sintered powder disk and low diffusion layer 206 and sintered wire disk uniform porosity layer 208, with the physical parameters previously given:

| Temperature | 325° C. | 150° C. | 125° C. |
|---|---|---|---|
| Cs emission rate (uG/cm$^2$/hr) | 6.4 | 0.82 | 0.023 |
| Monolayer loss rate (ML/hr) | 95 | 12 | 0.34 |
| Est Reservoir Lifetime (hr) | 110 | 870 | 31000 |

Figure 3:
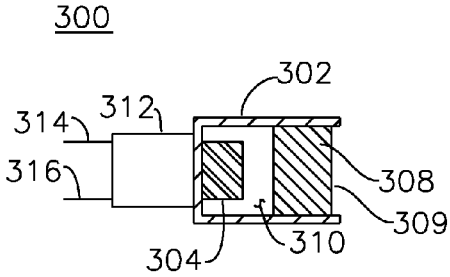
FIG. 3 is a cross section view of a cesium photocathode with a combined low diffusion layer and uniform porosity layer.
Figure 4:
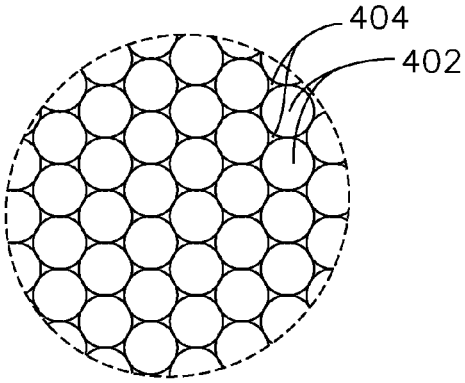
FIG. 4 is a cross section view of tungsten wires prior to sintering.
Figure 6:
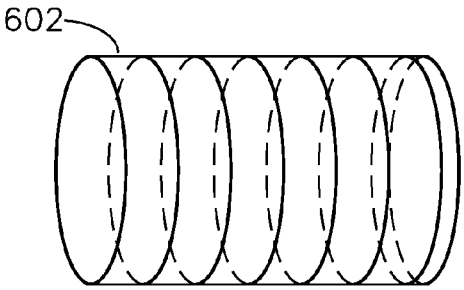
FIG. 6 is a perspective view of the tungsten wires of FIG. 5 formed into individual disks.

FIG. 4 shows a before and after view of the process for fabrication of the uniform porosity layer 208 of FIG. 2 for combined low diffusion uniform porosity layer 308 of FIG. 3. Individual wires 402, such as 20 u diameter tungsten, are gathered together into a circular packing boundary as shown using a inward radial concentrating force which keeps the wires in constant adjacent surface contact with each other. In one embodiment of the invention, the concentrating force is provided by a circumferential clamping fixture, the individual wires 402 are identical diameter, and quasi-triangular voids 404 are formed in hexagonal patterns between the individual wires 402. The sintering process consists of the application of radial pressure to encourage continuous surface contact between adjacent wires with the simultaneous application of a high temperature source which has a temperature which is slightly below the melting temperature of the wires 402, and this sintering condition is applied for a duration of time until the wire boundaries are joined to a desired degree, the sintering process leaving continuous open pores 402A, 402B between the sintered tungsten wires 404A, 404B. If the sintering is applied to a cylindrical form of wires as shown in FIG. 6, the next step after sintering is to cut the cylinder of tungsten wires perpendicular to the axes of the sintered wires, thereby forming individual disks which have the property of continuous axial pores such as 404A, 404B, which extend continuously from one surface to another. In this manner, the uniform porosity layer 208 of FIG. 2 serves the function of providing uniform density of photocathode material to the photocathode surface, and low diffusion uniform porosity layer 308 of FIG. 3 serves to both limit the rate of diffusion of photocathode material from the reservoir 304 as well as provide a uniform entry of cesium to the photocathode surface 309. In one embodiment of the invention, the individual wires 402 are 20 micron diameter, arranged in a hexagonal pattern of six wires surrounding each central wire, and the post-sintering size of pores 404A and 404B has a maximum dimension in the range of 2 to 8 microns measured perpendicular to the direction of the pore or wire axis.

The process for forming powdered sintered blocks of material for use in low diffusion layer 206 is well known in the field of powder metallurgy. Accordingly, diffusion layer 206 may be formed from tungsten powder with a grain size and distribution selected for the desired diffusion properties for the particular work function lowering material.

Figure 5:
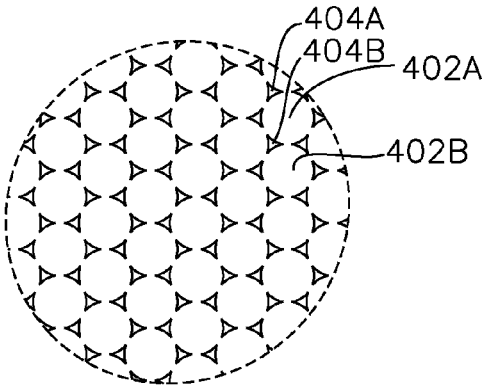
FIG. 5 is a cross section view of the tungsten wires of FIG. 4 after sintering.

Alternatively, low diffusion layer 206 may be formed from the same sintered wire process as was shown and described for FIGS. 4 and 5. In the case for forming low diffusion layer 206, this layer can be made thicker to provide longer channels or smaller pores and accordingly lower diffusion rates for controlling cesium delivery. Alternatively, the wires 402 used may have different diameter and form different pore patterns to reduce the number of pores formed, and with or without a change in wire 402 size, the wires 402 used to produce low diffusion layer 206 may be sintered to a greater extent to produce pores 404A, 404B with a smaller pore size than the pores of uniform porosity layer 208, since the objective of layer 206 is to provide a comparatively high resistance to cesium diffusion into free space layer 212 than the diffusion resistance of uniform porosity layer 208.

FIG. 3 shows another embodiment of the invention where heater 312 has electrical leads 314 and 316, and heater 312 is placed with a thermal coupling to cesium 304 which is supported by enclosure 302. The application of thermal energy from heater 312 causes cesium 304 to partially vaporize and fill free volume layer 310 with uniform density cesium, which is coupled to the combined low diffusion and uniform porosity layer 308, which may be formed from sintered wires which form continuous channels, and is presently believed to desirably provide the highest uniformity of cesium at the photocathode surface 309. Alternatively, the combined low diffusion and uniform porosity layer 308 may be formed from sintered powdered material such as a refractory or non-refractory metal. In this manner, a single layer 308 is possible which replaces the functions provided by low diffusion layer 206 and uniform porosity layer 208 of FIG. 2. Similar to FIG. 2, the photoelectric surface 309 is formed by the front surface of low diffusion uniform porosity layer 308 where the pores couple cesium to the front photoelectric surface 309, and the rate of delivery of cesium is controllable by the temperature of the heater 312, and the pore size and distribution in layer 308.

Since the photoelectric surfaces 209 and 309 typically operates at low temperatures on the order of 600° C., the process and materials for sintered metal disks 206, 208, 308 may be fabricated from copper, which has a melting point of approximately 1400° C. Alternatively, refractory metals, including at least one of niobium, molybdenum, tantalum, tungsten, and rhenium, or any metal with a melting point above the operating temperature of the photocathode, which is typically below 600° C. It is also possible to form the cathode from other metals, although the refractory metals, which have a melting point above 2000° C. and high hardness at room temperature, are suitable, and may optionally include at least one of titanium, vanadium, chromium, zirconium, hafnium, ruthenium, osmium and iridium. In one embodiment, tungsten is selected, as it is readily available in 20 micron diameter, and in another embodiment, copper is selected.

The uniform porosity layer 208 or 308 may be surface treated to improve quantum efficiency at the photoelectric surface. Several materials may be considered for such surface treatment of the uniform porosity layer 208 or 308 adjacent to the photocathode surface 209 or 309, respectively, or alternatively, the uniform porosity layer may be fabricated from these materials directly.

In one example embodiment, the quantum efficiency is improved by introducing a layer which forms an intermetallic compound with the cesium, the layer coating at least part of the uniform porosity layer or low diffusion layer and having at least one of the elements: antimony (Sb), gold (Au), tellurium (Te), bismuth (Bi), indium (In), gallium (Ga), thorium (Th).

In another example embodiment, improvement in quantum efficiency can be realized by internally creating an alloy of Cs by coating at least part of the uniform porosity layer or low diffusion layer with at least one of the elements: molybdenum (Mo), cobalt (Co), nickel (Ni), bismuth (Bi), platinum (Pt), or tantalum (Ta).

In another example embodiment, improvement in quantum efficiency can be realized by coating at least part of the uniform porosity layer or diffusion layer with an intermetallic compound, including at least one of osmium (Os), ruthenium (Ru), silver (Ag), or copper (Cu). The intermetallic compounds form a non-reactive layer over the uniform porosity layer or diffusion layer, which are subsequently coated with a sub-monolayer of Cs only, thereby providing well-defined surface diffusion and a quantum efficiency improvement over cesium-tungsten (CsW) alone. Additionally, silver may be activated by oxygen for additional improvement in quantum efficiency, as was described earlier by application of a silver coating onto the substrate, oxidizing by application of elevated temperature in an oxygenated environment, followed by the application of the cesium in a monolayer, with the introduction rate of cesium controlled by temperature for optimum quantum efficiency.

Figure 7:
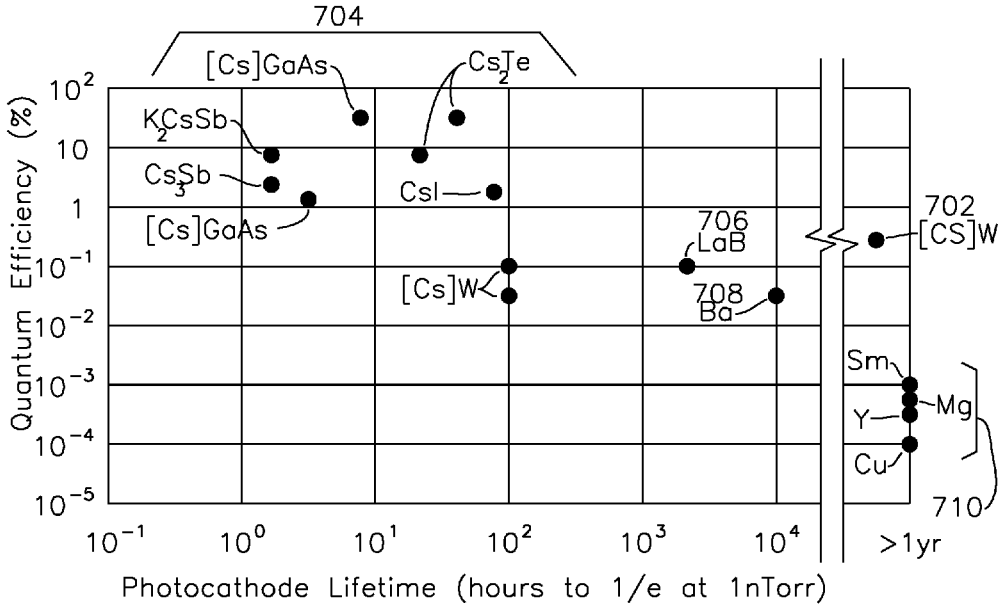
FIG. 7 is a scatter plot showing the quantum efficiency and lifetime for prior art devices and for the present invention.

Two design goals of the photoelectric cathode shown in FIGS. 2 and 3 are the generation of high quantum efficiency (QE) conversion of photons into electrons, and the preservation and optimum delivery of cesium from a dispenser reservoir to the photoelectric surface. In prior art photoelectric devices, there is not a mechanism to control the cesium feed rate, and the lifetimes of the cesium photoelectric cathodes were accordingly short, as shown in FIG. 7, which shows a tradeoff between quantum efficiency and photocathode lifetime. Point 702 represents one example of the present invention which has been characterized and uses the geometry similar to FIG. 2, having a compressed $Cs_2CrO_4$ pellet in a 0.6 cm diameter stainless steel enclosure with the low diffusion layer formed from 5 um powdered sintered tungsten. The cesium which diffuses through the sintered powder disk 206 is introduced into a free space volume of a 0.5 cm diameter by 0.05 cm high enclosure closed on one end, and having a photoemitting surface formed from the far side of a sintered tungsten wire disk, the near side coupled to the free space volume. In the present invention, the heater temperature may be varied to increase or decrease the cesium delivery rate to the photoelectric surface.

Figure 11:
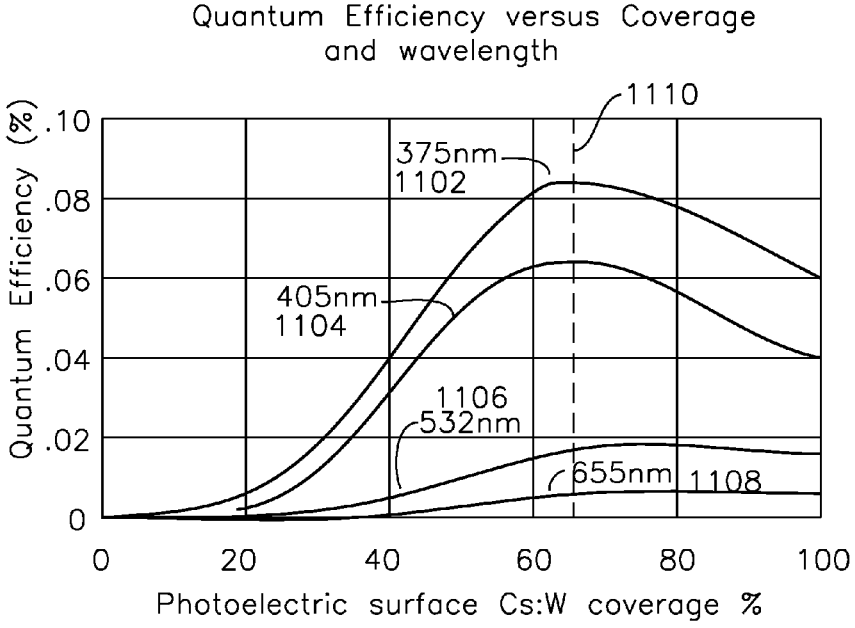
FIG. 11 is a plot of quantum efficiency versus coverage and photoelectric excitation wavelength.

It is desired to be able to determine the optimum rate of delivery of cesium to the photoelectric surface 209 or 309. FIG. 11 shows the relationship between coverage percent and quantum efficiency for a variety of wavelengths of laser power delivered to the photoelectric surface. Plot 1102 indicates that a quantum efficiency of 0.08% may be reached at 375 nm wavelength at 62% coverage of cesium over tungsten of the photoelectric surface. Plots 1104, 1108, and 1108 indicate the quantum efficiencies for 405 nm, 532 nm, and 655 nm optical sources, respectively. A coverage of 0% on the independent axis indicates that no cesium is present at all, and a coverage of 100% indicates the maximum amount of cesium on the surface which will bond directly to the tungsten substrate in a preferred lattice site. As can be seen from the plots of FIG. 11, a maximum quantum efficiency is reached at approximately 62% coverage highlighted with vertical line 1110. As can be seen, the introduction of additional cesium results in a drop in quantum efficiency. It is therefore desired to experimentally determine the preferred heater temperature for a particular photoelectric device from the corresponding maximum photoelectric quantum efficiency. If the cesium is delivered at an excessive rate through diffusion induced by a heater temperature which is too high, the quantum efficiency drops and the lifetime of the cathode is compromised, and if the cesium is delivered at an insufficient rate, the quantum efficiency becomes extremely low, as can be seen from FIG. 11.

Figure 8:
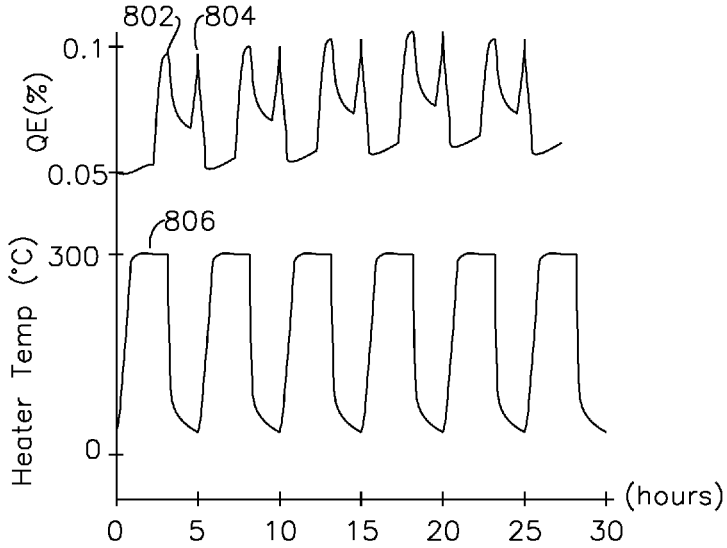
FIG. 8 is a plot of quantum efficiency through heating and cooling cycles at 325° C.
Figure 9:
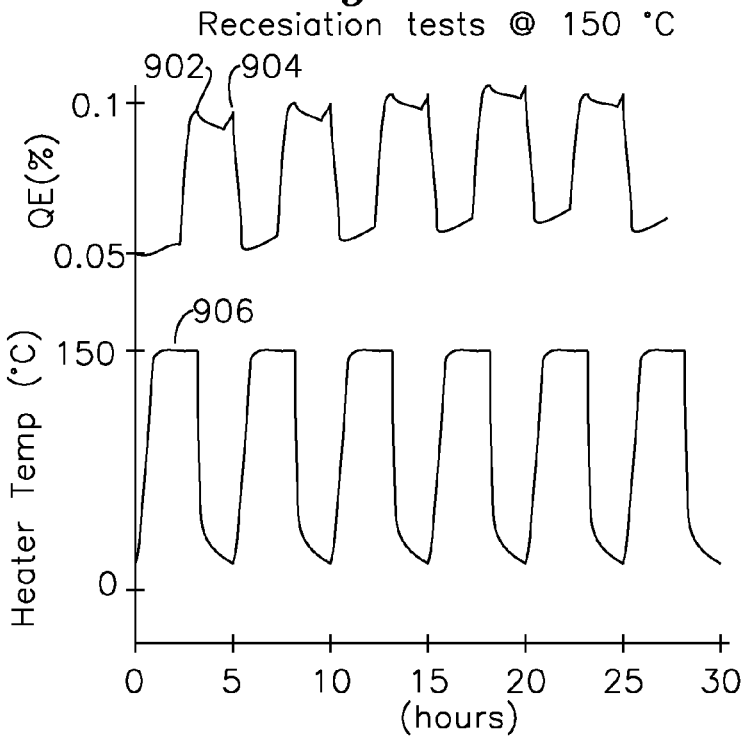
FIG. 9 is a plot of quantum efficiency through heating and cooling cycles at 150° C.
Figure 10:
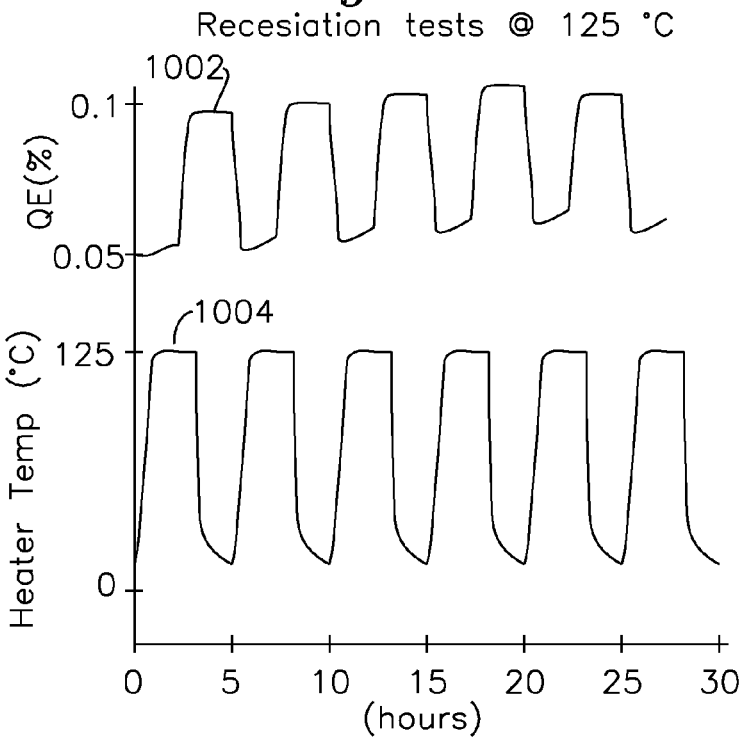
FIG. 10 is a plot of quantum efficiency through heating and cooling cycles at 125° C.

FIGS. 8 to 10 show one method for determining the optimum operating temperature of the photocathode. The rate of replacement of cesium is referred to as recesiation, and the rate of recesiation increases with increasing temperature. FIG. 8 shows a recesiation test at a heater temperature of 325° C., which is varied in 5 hour cycles from 0 to 325° C., during which time the quantum efficiency is measured to vary from 0.05 to 0.10. Significantly, it is seen that a double peak occurs, a first peak 802 and a second peak 804. The origin of the double peak in quantum efficiency is caused by cesium atoms which occupy neighboring lattice sites, and when the surface coverage increases, the dipoles normally formed as the bond with the tungsten begin to interfere with each other. The valence electron orbital of Cs, which is normally pulled strongly towards the surface, is now also pulled towards neighboring Cs atoms which have a partial positive charge. This weakens the dipole moment at high sub-monolayer coverages (in excess of 62%). The result is a slightly higher work function for photoemission at high coverage, and a lower QE. FIG. 8 shows that as the cathode temperature is increased and decreased, the coverage percentage increases and decreases as well (as a first order effect for clarity in understanding the phenomenon). Increasing temperature traverses the photoelectric cathode surface through higher coverages and through the QE peak at 62% as shown in 802, and yet additional heating introduce excess cesium and cause the device to operate near or above 100% coverage. This "overcoverage" operating point is to be avoided, as coverage layers in excess of 100% form additional monolayers on top of the first desired monolayer, and the second monolayer evaporates three orders of magnitude faster than the first monolayer, resulting in accelerated loss of cesium and a reduced quantum efficiency. When the heater is turned off, as the photoelectric cathode surface cools again, evaporation of excess cesium results in moving the operating point backwards through the optimum 62% coverage and the QE peaks again at point 804, at the same height as previously shown in first peak 802.

FIG. 9 shows the same device temperature cycling through 150° C., and it can be seen that first peak 902 and second peak 904 occur, but with less drop in efficiency. As there are two peaks present in the quantum efficiency, a lower operating point than 150° C. is desired.

FIG. 10 shows the same device temperature cycling through the optimum heater temperature of 125° C., and it can be seen that the peak quantum efficiency 1002 is reached, and without the double peak indicating sub-optimum operating point.

In one embodiment of the invention, a method for determining optimum operating point of a photoelectric cathode having a work function lowering material which is introduced through a diffusion process controlled by a heater temperature is performed with the following steps:

1) repetitively cycle the temperature of the heater between a temperature Tmax and a temperature sufficiently lower to reduce the quantum efficiency by at least a factor of two;

2) during the temperature cycling, observing the quantum efficiency of the photoelectric surface during a heating cycle and during a cooling cycle;

3) if a double peak in quantum efficiency is observed, a first peak during a heating cycle, and a second peak during a cooling cycle, reduce the temperature Tmax of the heater temperature cycle;

4) Repeat steps 1 to 3 until a double peak in quantum efficiency is no longer observed, using this Tmax as the operating temperature for the device during photoelectric cathode operation.

In the description of the invention, the outside surface 209 and 309 of the uniform porosity layer is the photoelectric interaction region, and is the surface for which coverage was previously defined. In one embodiment of the invention, the monolayer coverage utilizes cesium over the tungsten porous substrate. In another embodiment of the invention, a higher QE is achieved by coating the tungsten substrate surface with at least one other metal such as antimony, gold, or silver, and then applying at least one of the alkali metals (cesium, sodium, potassium, or lithium) in a particular ratio at a particular temperature. The alkali metals can alloy with the coating metal—they do not alloy with tungsten or silver, but do alloy with antimony or gold—to create a semiconductor, which has an improved QE for a variety of reasons, including improved electron transport within the metal from the subsurface absorption of the photon and excitation of the electron to the surface for emission. Using this alternative construction, electrons will scatter on their way to the surface and lose energy in each scattering event. A semiconductor formed in this way has an advantage over a metal, as electron-to-electron scattering removes half of the electron energy at each scattering event. In semiconductors, electrons have less overall scattering and when they do scatter it is usually an electron-phonon scattering event, where only a few milli-electron volts (meV) are lost, leaving excess energy to overcome the work function. For these reasons, it is desirable in one embodiment of the invention to form a semiconductor layer over the tungsten, the semiconductor layer formed by first applying at least one other metal such as antimony, gold, or silver, and then applying an alkali metal (including at least one of cesium, sodium, potassium, or lithium) in a particular ratio at a particular temperature.

The examples provided are for understanding the invention and are not intended to limit the scope of the invention to the embodiments shown. For example, the low diffusion layer may be formed from any material which provides a limited diffusion rate which rate can be controlled by a heater element, and the uniform porosity layer may be formed from any material which provides uniformity of emission over a region of photoelectric interaction.

We claim:

1. A photoelectric cathode having:

a heater element;

a work function lowering material thermally coupled to said heater element;

a low diffusion layer formed by a material having a plurality of passageways which reduce the diffusion rate of said work function lowering material;

a uniform porosity layer providing a greater diffusion rate than said low diffusion layer and also providing a plurality of apertures which are uniformly separated in space;

said uniform porosity layer having an outward facing photoelectric interaction surface;

an enclosure surrounding said work function lowering material, said low diffusion layer, and said uniform porosity layer, said low diffusion layer and said uniform porosity layer separated by a free space layer;

whereby said heater element causes said work function lowering material to pass through said low diffusion layer and into said free space layer, thereafter through said uniform porosity layer to said photoelectric interaction surface.

2. The photoelectric cathode of claim 1 where said uniform porosity layer is formed from a plurality of sintered wires.

3. The photoelectric cathode of claim 1 where said wires are formed from tungsten.

4. The photoelectric cathode of claim 3 where said wires are on the order of 20 micron diameter, and sintering creates pores with a cross section perpendicular to the wire axes having a maximum pore dimension on the order of 4 microns.

5. The photoelectric cathode of claim 3 where said refractory metal is tungsten.

6. The photoelectric cathode of claim 1 where said low diffusion layer is formed by a sintered refractory metal powder.

7. The photoelectric cathode of claim 6 where said sintered metal powder has pores with a maximum dimension on the order of 1 micron.

8. The photoelectric cathode of claim 1 where said work function lowering material is cesium.

9. The photoelectric cathode of claim 1 where the volume formed by said low diffusion layer and said enclosure is filled with said work function lowering material to form a dispenser with a diffusion rate controlled by said heater.

10. The photoelectric cathode of claim 1 where either the low diffusion layer or the uniform porosity layer is formed from at least one of the refractory metals niobium, molybdenum, tantalum, tungsten, and rhenium, or it is formed from copper.

11. The photoelectric cathode of claim 10 where either the low diffusion layer or the uniform porosity layer is coated with at least one of: antimony (Sb), gold (Au), tellurium (Te), bismuth (Bi), indium (In), gallium (Ga), thorium (Th), molybdenum (Mo), cobalt (Co), nickel (Ni), bismuth (Bi), platinum (Pt), tantalum (Ta), osmium (Os), ruthenium (Ru), silver (Ag), or copper (Cu).

12. A photoelectric cathode having:

an enclosure thermally coupled to a heater;

a low diffusion and uniform porosity layer placed in the enclosure and thereby forming a reservoir surrounding a work function lowering material;

a photoelectric cathode surface formed by an outer surface of the low diffusion and uniform porosity layer;

where the heater temperature is varied to cause the work function lowering material to form a monolayer of work function lowering material on the surface of the photoelectric cathode surface.

13. The photoelectric cathode of claim 12 where the work function lowering material is Cesium.

14. The photoelectric cathode of claim 13 where the low diffusion and uniform porosity layer is formed from sintered wires which have pores substantially perpendicular to the photoelectric cathode surface.

15. The photoelectric cathode of claim 14 where the wires are on the order of 20 micron in diameter and the pores are on the order of 4 microns in extent perpendicular to the axes of the wires.

16. The photoelectric cathode of claim 13 where the low diffusion and uniform porosity layer is formed from a sintered powdered metal.

17. The photoelectric cathode of claim 13 where the low diffusion and uniform porosity layer is formed from at least one of the refractory metals niobium, molybdenum, tantalum, tungsten, and rhenium, or it is formed from copper.

18. The photoelectric cathode of claim 17 where the low diffusion and uniform porosity layer is coated with at least one of: antimony (Sb), gold (Au), tellurium (Te), bismuth (Bi), indium (In), gallium (Ga), thorium (Th), molybdenum (Mo), cobalt (Co), nickel (Ni), bismuth (Bi), platinum (Pt), tantalum (Ta), osmium (Os), ruthenium (Ru), silver (Ag), or copper (Cu).

19. A process for optimizing a quantum efficiency of a photoelectric cathode having a heater coupled to a dispenser cathode for diffusing work function lowering material from a reservoir to a photoelectric surface, the process having:

a heater cycling step for repetitively cycling a heater between a first temperature and a second temperature greater than the first temperature, the first temperature selected for reduced diffusion rate and the second temperature selected as a possible target operating temperature, the first temperature maintained for a duration of time sufficient for work function lowering material to be consumed until less than a monolayer of work function material is present on a photoelectric cathode surface, the second temperature maintained for a duration of time sufficient for diffusion of the work lowering material to reach steady-state;

measuring a quantum efficiency during at least one cycle from initial application of the second temperature to application of a first temperature and ending at the application of the second temperature;

reducing the second temperature if a double peak in quantum efficiency is observed;

increasing the second temperature if a single peak in quantum efficiency is observed;

selecting the operating temperature based on the maximum second temperature which has a single peak in quantum efficiency.

* * * * *